US009764522B2

(12) United States Patent
Desser et al.

(10) Patent No.: US 9,764,522 B2
(45) Date of Patent: Sep. 19, 2017

(54) CLOTHING COMPRESSION PRESS AND METHOD OF COMPRESSING CLOTHING

(71) Applicants: John Desser, Byron Center, MI (US); Paul Land, Byron Center, MI (US)

(72) Inventors: John Desser, Byron Center, MI (US); Paul Land, Byron Center, MI (US)

( * ) Notice: Subject to any disclaimer, the term of this patent is extended or adjusted under 35 U.S.C. 154(b) by 195 days.

(21) Appl. No.: 14/243,922

(22) Filed: Apr. 3, 2014

(65) Prior Publication Data

US 2014/0338547 A1 Nov. 20, 2014

Related U.S. Application Data

(60) Provisional application No. 61/823,934, filed on May 16, 2013.

(51) Int. Cl.

*B30B 13/00* (2006.01)
*B30B 9/30* (2006.01)
*B65B 63/02* (2006.01)

(52) U.S. Cl.

CPC ..... *B30B 9/301* (2013.01); *B30B 9/3014* (2013.01); *B30B 9/3032* (2013.01); *B30B 13/00* (2013.01); *B65B 63/02* (2013.01)

(58) Field of Classification Search

CPC ..... B30B 13/00; B30B 9/301; B30B 9/3032; B30B 9/3014; B65B 63/02; B65B 63/022; B65B 63/026

USPC ..... 100/2, 3

See application file for complete search history.

(56) References Cited

U.S. PATENT DOCUMENTS 1,493,946 A * 5/1924 Abbott ..... B30B 9/3082 100/257
3,099,952 A * 8/1963 Olaf ..... B30B 9/30 100/215
3,916,781 A * 11/1975 Cerniglia ..... B30B 9/3021 100/218
4,232,599 A * 11/1980 Ulrich ..... B30B 9/3014 100/218
4,343,131 A * 8/1982 McCormick ..... B65B 13/20 100/3
4,363,267 A * 12/1982 Greer ..... B30B 9/3032 100/255
4,414,788 A * 11/1983 Berg ..... B65B 1/24 100/219
5,200,269 A * 4/1993 Lukhard ..... B65B 27/12 100/3
5,524,531 A * 6/1996 Merry ..... B65B 63/02 100/240

(Continued)

FOREIGN PATENT DOCUMENTS

FR 2301383 A1 * 9/1976 ..... B30B 9/3064
GB 1505640 A * 3/1978 ..... B30B 9/3014

*Primary Examiner* — Jimmy T Nguyen

(74) *Attorney, Agent, or Firm* — The Watson I.P. Group, PLC; Jovan N. Jovanovic; Vladan M. Vasiljevic

(57) ABSTRACT

A clothing compression press that is of a sufficient height so as to compact clothing for baling in a single pass of a piston within the chamber. The press includes an inner cavity defined by a base with a front wall, a back wall and first and second sidewalls extending upwardly therefrom. A plate extends within the inner cavity which is driven by a hydraulic cylinder from a first position spaced apart from the base to a second position proximate the base, to in turn, compress clothing between the plate and the base.

11 Claims, 3 Drawing Sheets

(56) References Cited

U.S. PATENT DOCUMENTS

| | | | | | |
|---|---|---|---|---|---|
| 6,000,325 | A | * | 12/1999 | Schwelling | B30B 9/3014 100/218 |
| 6,085,914 | A | * | 7/2000 | Tobaccowala | B07C 7/005 100/91 |
| 7,540,126 | B2 | * | 6/2009 | Abbott | B65B 25/20 53/438 |

* cited by examiner

CLOTHING COMPRESSION PRESS AND METHOD OF COMPRESSING CLOTHING

CROSS-REFERENCE TO RELATED APPLICATION

This application claims priority from U.S. Provisional Patent Application Ser. No. 61/823,934 filed May 16, 2013, entitled "Clothing Compression Press And Method of Compressing Clothing," the entire specification of which is hereby incorporated by reference.

BACKGROUND OF THE DISCLOSURE

1. Field of the Disclosure

The invention relates in general to baling equipment, and more particularly, to a clothing compression press and a method of compressing clothing. Such a press and method is particularly well suited for the shipping of clothing in the form of aid packaging. The disclosure is not, however, limited to such use.

2. Background Art

The baling of items through compression is known in the art. In many instances, baling equipment is used to crush cardboard for purposes of shipping to recycling plants and the like.

It has been found that such equipment is also well suited to bale clothing for shipment as aid to those in need. In the case of clothing, a large amount of compression is possible, and a relatively large amount of clothing can be compressed into relatively small bales.

Generally, however, due to the loose nature of clothing, current baling equipment renders the process exceedingly labor intensive. For example, in the case of compressing clothing, it is necessary to sequentially introduce clothing and press the clothing to build up a single bale. That is, generally a bale requires enough clothing to refill the cavity of the press several times. Each time the press cavity is refilled, it is necessary to run the press to compress that which has been introduced. As a result, a relatively great deal of time is taken for each intermediate pressing. Additionally, there is an increase in the amount of labor that is required for such a press as a number of fillings and compression steps are required to make a single bale.

Thus, it is an object of the present disclosure to provide an improved clothing compression press and means of compressing clothing.

SUMMARY OF THE DISCLOSURE

The disclosure is directed to method of compressing clothing in a single pass. The method comprises the steps of providing a clothing compression press having a housing with a base and a generally uniform cavity extending above the base, and a press slidably movable within the base toward and away from the housing, a lower opening being positioned proximate the base and an upper opening provided spaced apart from the base and below an upper limit of the press; extending the press above the upper opening; providing clothing; inserting clothing into the housing through the upper opening until substantially the entirety of the housing is filled with clothing; directing the press toward the base and into contact with the clothing; stopping the press in a spaced apart orientation from the base when a desired level of compression is reached, with the press being precluded from extending above the upper opening after initiating the step of directing, so as to provide a single pass of the press, and precluding further insertion of clothing into the housing between the press and the clothing provided in the step of providing; strapping the clothing compressed by the press; and removing the clothing after strapping from the housing through the lower opening.

In a preferred embodiment, the step of directing further comprises the step of directing the press beyond the upper opening and between the base and the upper opening only once, without directing the press in the opposite direction to again place the upper opening between the base and the press.

In another preferred embodiment, the lower opening further includes a door and a locking mechanism so as to permit selective locking of the door in a position wherein the door covers the lower opening. In such an embodiment, the method further comprises the step of closing and locking the door before the step of directing the press.

In another preferred embodiment, the locking mechanism further includes a locking plate which includes a substantially L-shaped component with a base and a leg extending from the base. The base is hingedly coupled to a sidewall of the housing, opposite a hinge coupling the door to the housing. In an engaging position, the leg extends over a portion of the door when the door is in a closed orientation, thereby precluding the opening of the door.

In another preferred embodiment, the locking mechanism further includes an actuator that is configured to rotate the locking plate into and out of the engaging position about the hinge, so as to selectively lock and unlock the door over the lower opening. The step of locking further comprises the step of actuating the actuator so as to rotate the locking plate into the engaged position.

In another preferred embodiment, a lift is provided having a base positioned within the housing. The lift is hingedly coupled to the housing by way of a lift hinge proximate the lower opening, so as to be rotatable thereabout. In such an embodiment, the step of removing the clothing further comprising the step of rotating the base of the lift relative to the hinge so as to incline the clothing after strapping toward the lower opening.

In some such preferred embodiments, the lift further includes a raising mechanism coupled to the base and spaced apart from the lift hinge.

Preferably, the raising mechanism comprises a hydraulic actuator.

In another preferred embodiment, the housing is at least 15 feet tall.

Preferably, the housing has a substantially rectangular cross-sectional configuration.

In another preferred embodiment, the upper opening further includes a conveyor extending toward the ground therefrom, to facilitate the placement of clothing into the housing through the upper opening.

BRIEF DESCRIPTION OF THE DRAWINGS

The disclosure will now be described with reference to the drawings wherein.

DETAILED DESCRIPTION OF THE DISCLOSURE

Figure 1:
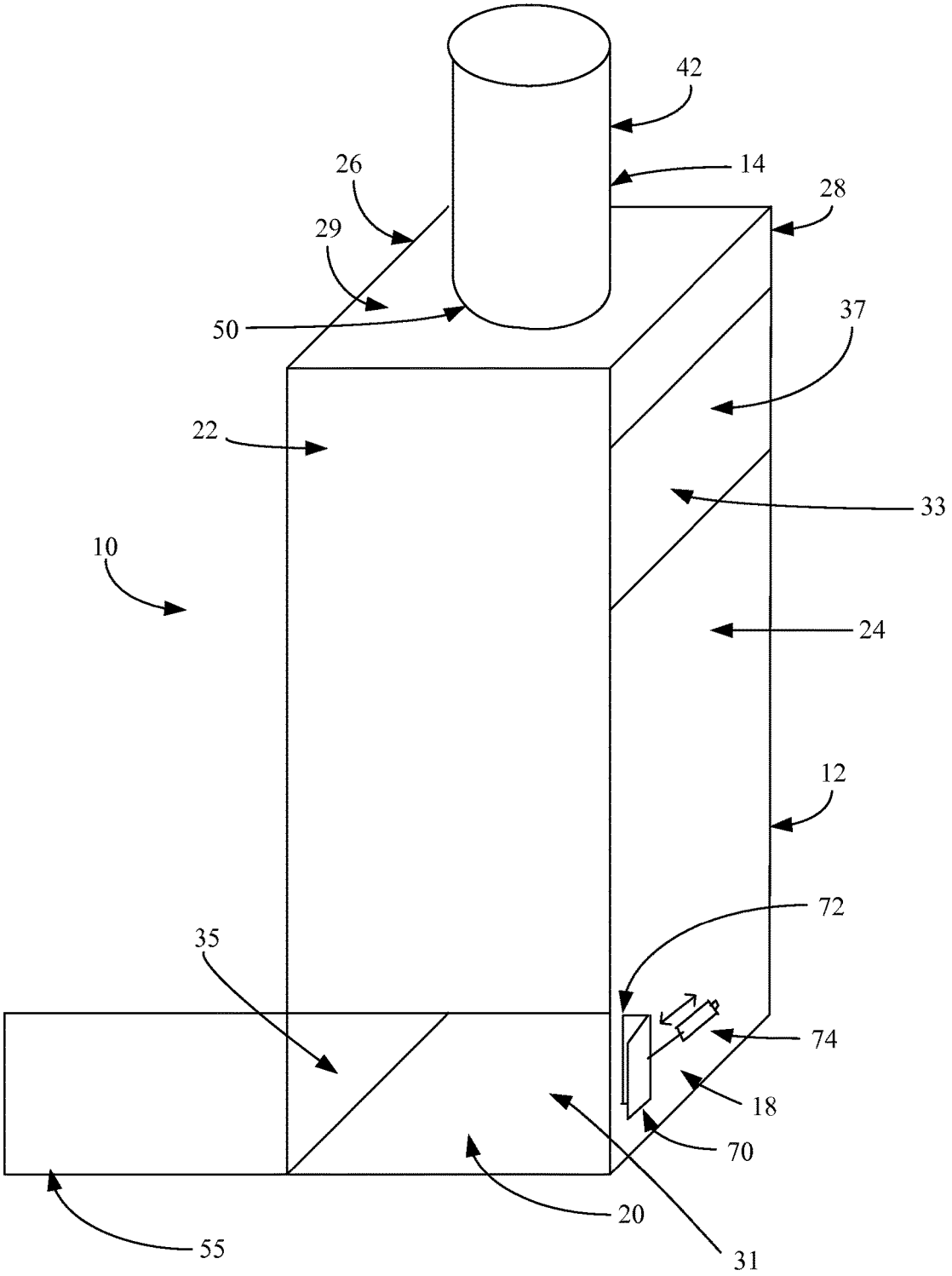
FIG. 1 of the drawings is a perspective view of the clothing compression press of the present disclosure.
Figure 2:
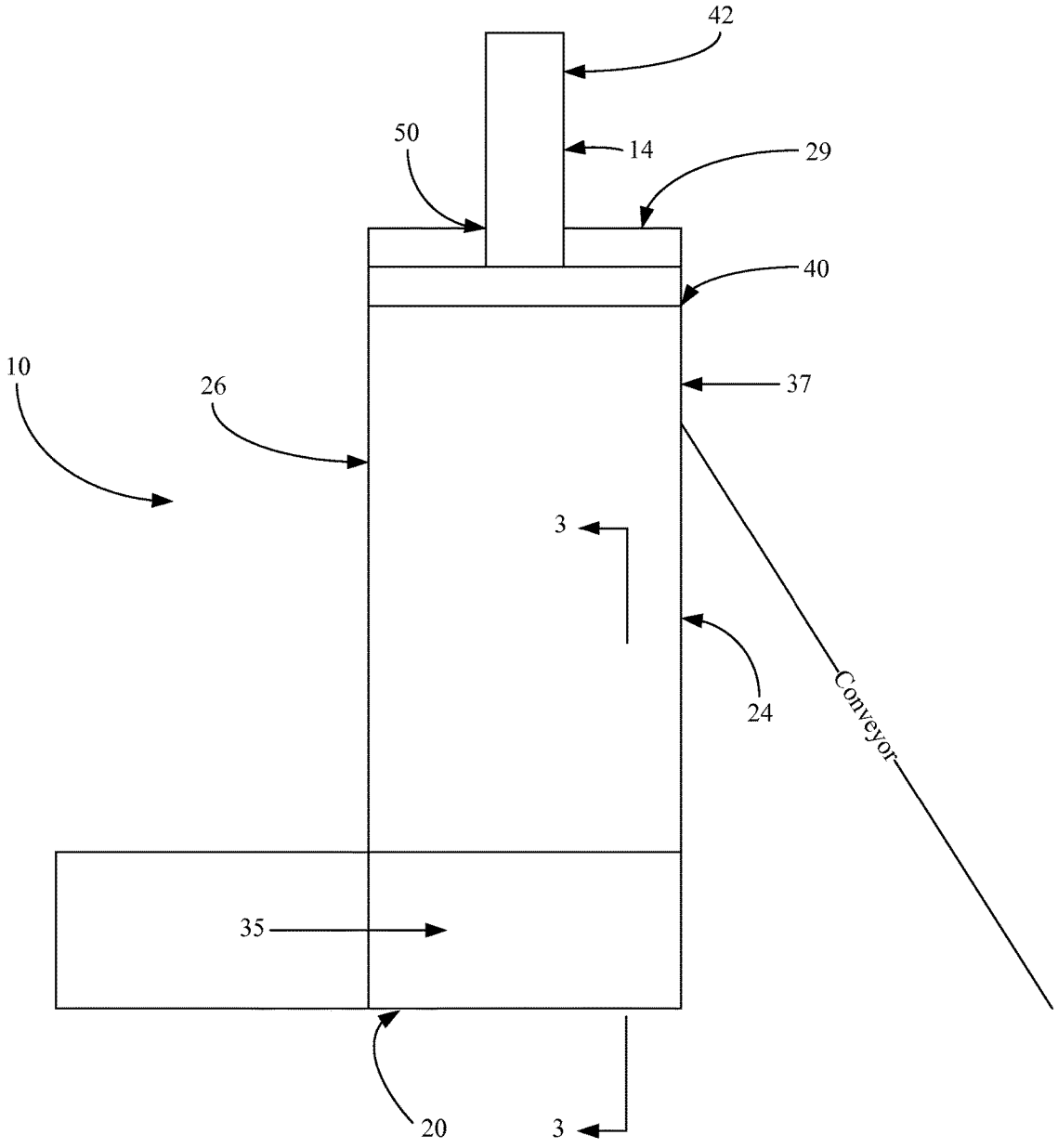
FIG. 2 of the drawings is a cross-sectional view of the clothing compression press of the present disclosure.
Figure 3:
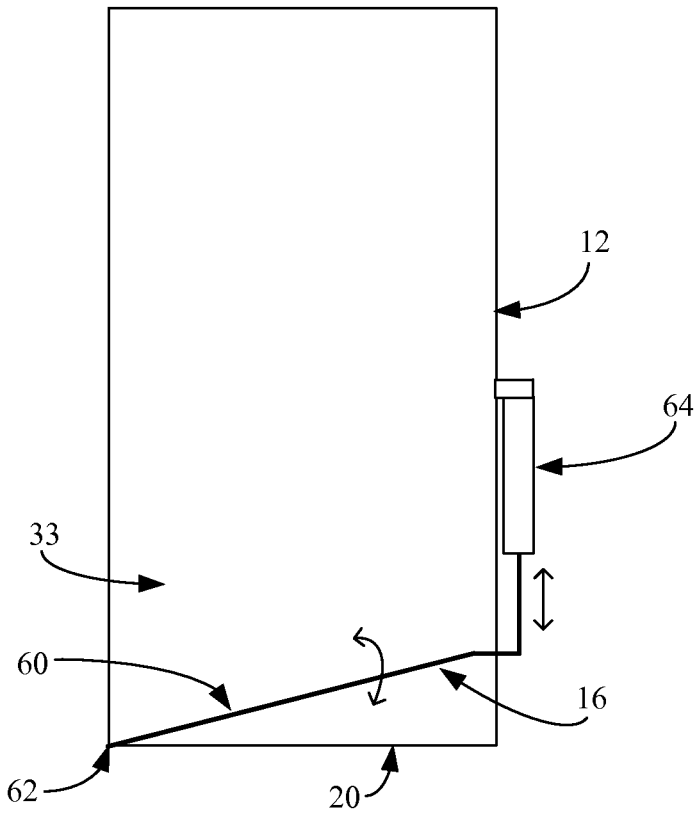
FIG. 3 of the drawings is a partial cross-sectional view of the clothing compression press of the present disclosure, taken generally about lines 3-3 of FIG. 2.

While this invention is susceptible of embodiment in many different forms, there is shown in the drawings and described herein in detail a specific embodiment with the understanding that the present disclosure is to be considered as an exemplification and is not intended to be limited to the embodiment illustrated It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIG. 1, the clothing compression press is shown generally at 10. The clothing compression press comprises housing 12 and press 14. Unlike prior art presses, the press of the present disclosure is configured to compress and bale a full pallet of compressed clothing in a single pressing. Prior art presses require a substantially greater labor effort by repeatedly filling and pressing until a full bale has been formed.

The housing 12 is shown in FIG. 1 as comprising base 20, front wall 22, first sidewall 24, second sidewall 26, back wall 28 and top wall 29. The base 20 has a generally square or rectangular configuration with the walls maintaining a generally consistent cross-sectional area 31 and overall cavity 33. The walls are generally perpendicular and parallel to each other to maintain the consistent cross-sectional area that matches the base. In the embodiment shown, the first sidewall and the second sidewall are parallel to each other and perpendicular to both the back wall and the front wall, and all of these are perpendicular to the top wall and the base. Of course, other configurations are also contemplated, including other cross-sectional shapes (square, circular, oval, polygonal, random), however, it will be understood that generally a rectangular and/or square configuration generally matches currently existing and commonly used pallets.

The housing walls are formed from a metal material that can withstand the pressure exerted outwardly by the clothing under compression. In one embodiment, the walls are formed from a steel member and may include reinforcing frame structures.

The front wall may have lower opening 35 which is positioned just above the base 20. The lower opening 35 provides ingress into the cavity 33 for multiple purposes. First, the compressed clothing can be removed through the lower opening 35. Additionally, the compressed clothing can be baled (as will be explained below), with access being provided through the lower opening 35. Depending on the particular type of clothing, and/or the particular requirements for baling, the size of the lower opening 35 can be varied. It will be understood that the opening is also configured to receive the forks of a fork lift truck and the like. It will be understood that a door 55 is configured to rotatably cover the lower opening 35. In particular, in the embodiment disclosed, the door is hinged on one side of the front wall proximate the second side wall. The door can be selectively rotated so as to be closed or open and out of the way of the lower opening so as to permit full access thereto.

It is contemplated that the system may further include a lift assembly 16 to provide assistance with removing the bales from within the housing. In the embodiment shown, the lift assembly 16 includes base 60 which overlies the base 20 and includes an upper surface which becomes the upper surface upon which the pallet is positioned and configured to receive the clothing or other loose items. The base is typically hinged via hinge 62 which extends across the base 60 proximate the wall having the lower opening, or, in the embodiment shown, the front wall. As such, the base 60 can be rotated about the hinge so that it is inclined upwardly from the front wall to the back wall. It is contemplated that the operating range of the base may be between 0° and 90°, although it is contemplated that the range of operation may only need to be between 0° and 30°, wherein the raising of the base at such an angle is sufficient to allow the bale to slide out of the housing through the lower opening.

The lift assembly further includes a raising mechanism 64 which is configured to rotate the base 60 about the hinge 62. In the embodiment shown, the raising mechanism comprises a hydraulic cylinder which has one end fixed to the housing and one end fixed to the base 60 spaced apart from the hinge. Thus, actuation of the hydraulic cylinder causes the two ends to either be directed toward or away from each other (effectively changing the length thereof), which raises or lowers the base 60 about hinge 62.

Additionally, in the preferred embodiment a locking mechanism 18 may be employed so as to maintain the lower opening 35 in a closed configuration. This is particularly useful to preclude the inadvertent removal of clothing during the filling process through an inadvertent door opening. In addition, such a lock increases safety of the system. Such a locking mechanism 18 further includes locking plate 70 which has an elongated configuration with an L-shaped cross-sectional configuration. The locking plate 70 is hinged about hinge 72 to the side wall 24 so that when rotated, the base of the locking plate abuts the side wall 24 while the leg portion overlies the front wall, and, in particular, the door at the end opposite the hinge. As such, while the locking plate is in such an engaged configuration, the door remains closed and cannot be opened. An actuator 74 is positioned at the first side wall with one end coupled to the locking plate in a spaced apart orientation from the hinge, and the other end coupled to the side wall. As such, when actuated in a first direction, the lock is moved into the engaging position, and when moved in the second direction, the lock is moved into the disengaging position.

The back wall or the side wall may further include upper opening 37. The opening 37 is positioned proximate the top wall 29. Preferably the opening 37 is spaced apart therefrom at least a bit to allow for the inclusion of componentry related to the press 14. The opening 37 can be sized so as to allow for the ingress of loose clothing for compression within the press 10. The opening 37 can be covered with a door that is hinged to either the sidewall, the back wall, or the top wall. Of course, other systems are also contemplated, including an embodiment wherein the door is omitted altogether. It is contemplated that the upper opening is on a wall that is different than the lower opening so that access can be made to each without being in the way of the other.

It is contemplated that the cavity 33 defined by the base, sidewalls and the top wall be on the order of fourteen to twenty five feet tall, and is preferably at least fifteen feet tall (while not required to be such a height) such that the clothing can be inserted a single time through the upper opening, for a single stroke compression. It is also contemplated that the cross-sectional area 31 of the base, and, indeed the housing itself, substantially match in size commonly used pallet sizes such that the compressed clothing is ready for shipping without any repackaging, repositioning, etc.

The press 14 includes plate (or, piston face member) 40 which is coupled to hydraulic cylinder 42. The hydraulic cylinder 42 is coupled to the top wall 29, and extends through the piston opening 50 and interfaces with the plate 40. It will be understood that the plate 40 substantially corresponds in shape to the cross-sectional area 31. It will be understood that the hydraulic cylinder is sized so as to be able to direct the plate 40 from a position proximate the top wall 29 to a position proximate the base 20, which corresponds to being able to extend between a starting position and a baled position. In the baled position, the plate 40 is separated from the base 20 a distance which is less than the desired height of the finished bale. A plurality of undulations or slots may be transposed onto the plate 40 to facilitate the passage of bands between the clothing and the plate, for baling the clothing prior to removal from within the press.

In operation, the plate 40 is retracted into the starting position by the hydraulic cylinder 42. A pallet may be positioned on the base 60 of the lift 16 which overlies the base 20 of the housing and the raising mechanism is employed so at to position the base in a generally horizontal position (which is the resting position on the base 20 of the housing). Generally the locking mechanism is actuated to lock the front door over the lower opening 35 so that ingress or egress through the front door is precluded, and the front door is not allowed to inadvertently open.

Next, loose clothing is then inserted through the upper opening 37 in back wall 28. In one embodiment, a conveyor can be set to run from the ground to the upper opening 37. It will be understood that the upper opening 37 is almost 20 feet above the ground, and as such, a conveyor can easily transport the loose clothing to the opening. Once a predetermined quantity of clothing has been introduced into the inner cavity 33, further insertion of clothing is stopped. It will be understood that through trial and error, the amount of clothing that is needed to form a desired bale of a desired size and weight can be determined. It will also be understood that in certain embodiments, a substantial majority of the inner cavity can be filled with loose clothing to achieve the predetermined amount.

Once the necessary quantity of loose clothing has been introduced, the upper opening 37 can be closed (or can remain open in certain embodiments). It will be understood that clothing is quite loose and the entirety of the housing can be filled only to result in a pallet with only a couple of feet of compacted clothing thereon. The hydraulic cylinder 42 is then activated, and the plate 40 is directed through the inner cavity from the top wall to toward the base. As the plate progresses downwardly, eventually, the clothing is compacted between the sidewalls, the front wall and the back wall and the plate toward the base. In many embodiments, a pallet or other material is positioned at the base, and bales are prepared at the base to facilitate baling the compacted clothing.

When the desired level of compacting has been achieved, the user can through the lower opening 37 apply any desired bales or other retaining structures to maintain the clothing in the compacted configuration. It may be necessary to open the door over the lower opening 35 to achieve the same. Once baled or otherwise secured, the user can reverse the hydraulic cylinder 42 and begin returning the plate toward the initial position. At that time, the compacted clothing can be removed from within the cavity through the lower opening 35 in the front wall 22.

To assist with the removal of the pallet from within the housing, the lift 16 can be activated by actuating the raising mechanism. The actuation rotates the base 60 about the hinge 62 until the inclination overcomes the resistance caused by frictional contact between the pallet and the base. Once this is achieved, the palletized clothing slides out of the housing through the lower opening.

The plate 40 is returned to its original position, and the cycle is ready to be repeated to form a second, or additional bale. Additionally, the actuator can be activated to rotate the base in the other direction about the hinge so as to lower the base back to a generally horizontal orientation.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A method of compressing clothing in a single pass comprising the steps of:

providing a clothing compression press having a housing with a base and a generally uniform cavity extending above the base, and a press plate slidably movable within the housing toward and away from the base, a lower opening being positioned proximate the base with a door positionable to cover the lower opening and an upper opening provided spaced apart from the base and below an upper limit of the press plate, wherein the upper opening is spaced apart from an upper end of the lower opening a distance that is substantially greater than a height of the lower opening;

extending the press plate above the upper opening;

placing a pallet on the base;

closing the door so as to cover the lower opening;

providing a first quantity of clothing;

inserting the first quantity of clothing into the housing through the upper opening until substantially the entirety of the housing is filled with the first quantity of clothing;

directing the press plate toward the base and into contact with the first quantity of clothing;

compressing the first quantity of clothing in a single pass through only one compression of the first quantity of clothing by the press plate until a desired level of compression is reached, with the press plate being precluded from extending above the upper opening after initiating the step of directing, so as to provide only one compression of the first quantity of clothing by the press plate forming a complete bale with only the first quantity of clothing, and precluding further insertion of any clothing into the housing after the step of compressing has been initiated;

bailing to the pallet the first quantity of clothing compressed by the press plate in only one compression of the first quantity of clothing by the press plate while the first quantity of clothing is compressed so as to form a complete bale with the only the first quantity of clothing;

opening the door covering the lower opening; and removing the first quantity of clothing after bailing from the housing through the lower opening.

2. The method of claim 1 wherein the step of directing further comprises the step of directing the press plate beyond the upper opening and between the base and the upper opening only once, without directing the press plate in the opposite direction to again place the upper opening between the base and the press plate.

3. The method of claim 2 wherein the clothing compression press further includes a locking mechanism so as to permit selective locking of the door in a position wherein the door covers the lower opening, the method further comprises the step of locking the door before the step of directing the press plate.

4. The method of claim 3 wherein the locking mechanism further includes a locking plate which includes a substantially L-shaped component with a base and a leg extending from the base, the base being hingedly coupled to a sidewall of the housing, opposite a hinge coupling the door to the housing, wherein when in an engaging position, the leg extends over a portion of the door when the door is in a closed orientation, thereby precluding the opening of the door.

5. The method of claim 4 wherein the locking mechanism further includes an actuator that is configured to rotate the locking plate into and out of the engaging position about the hinge, so as to selectively lock and unlock the door over the lower opening, and the step of locking further comprises the step of actuating the actuator so as to rotate the locking plate into the engaged position.

6. The method of claim 3 further comprising a lift having a base positioned within the housing, the lift hingedly coupled to the housing by way of a lift hinge proximate the lower opening, so as to be rotatable thereabout, the step of removing the clothing further comprising the step of: rotating the base of the lift relative to the hinge so as to incline the clothing after strapping toward the lower opening.

7. The method of claim 6 wherein the lift further includes a raising mechanism coupled to the base and spaced apart from the lift hinge.

8. The method of claim 7 wherein the raising mechanism comprises a hydraulic actuator.

9. The method of claim 1 wherein the housing is at least 15 feet tall.

10. The method of claim 1 wherein the housing has a substantially rectangular cross-sectional configuration.

11. The method of claim 1 wherein the upper opening further includes a conveyor extending toward the ground therefrom, to facilitate the placement of clothing into the housing through the upper opening.

* * * * *